US005096274A

United States Patent [19]

Fuschetto et al.

[11] Patent Number: 5,096,274

[45] Date of Patent: Mar. 17, 1992

[54] CANDLE BEARING CEREMONIOUS CAKE SHIELD

[76] Inventors: Antonio Fuschetto, 3636 Dorrit Ave.; Anthony Liberti, 3662 Edgar Ave., both of Boynton Beach, Fla. 33436

[21] Appl. No.: 538,379

[22] Filed: Jun. 15, 1990

[51] Int. Cl.[5] ..... A47G 19/26

[52] U.S. Cl. ..... 312/284; 306/45.34

[58] Field of Search ..... 312/284; 206/45.32, 206/45.34, 45.31, 606, 627; D7/540, 610; 431/289, 295; 119/15, 17

[56] References Cited

U.S. PATENT DOCUMENTS

| | | | |
|---|---|---|---|
| D. 285,159 | 8/1986 | Wexler . | |
| 1,125,855 | 1/1915 | Mapes | D7/610 |
| 1,511,004 | 10/1924 | Pooch et al. . | |
| 2,104,139 | 1/1938 | Sherwood . | |
| 2,322,519 | 6/1943 | Ingebrigtsen . | |
| 2,468,505 | 4/1949 | McNeill . | |
| 2,758,458 | 8/1956 | Carlson | D7/610 |
| 2,865,552 | 12/1958 | Sider et al. | 206/627 |
| 2,960,770 | 11/1960 | Valenta . | |
| 3,786,914 | 1/1974 | Beutler | 206/606 |
| 3,819,455 | 6/1974 | MacKendrick | D7/610 |
| 4,219,119 | 8/1980 | Zefran | 206/457 |
| 4,375,862 | 3/1983 | Kurinsky et al. | 206/45.32 |
| 4,413,725 | 11/1983 | Bruno et al. | 206/627 |
| 4,444,795 | 4/1984 | Weinstein | 206/627 |
| 4,721,455 | 1/1988 | Barfus | 431/295 |
| 4,884,966 | 12/1989 | Wexler | 312/284 |
| 4,924,810 | 5/1990 | Tominaga | 119/15 |
| 4,938,688 | 7/1990 | Wexler | 312/284 |

*Primary Examiner*—Kenneth J. Dorner
*Assistant Examiner*—Brian K. Green
*Attorney, Agent, or Firm*—Eckert Seamans Cherin & Mellott

[57] ABSTRACT

A celluloid transparent cake cover, preferably disposable, that is to be placed over a circular or rectangularly shaped cake. The horizontal top of the cover contains a plurality of depressions that are intended to hold and support candles. A slotted groove is also provided in the horizontal top cover for containing and supporting known wax candle numerals. A number of aesthetically pleasing features are also incorporated including arched windows around the perimeter of the sidewalls of the cover and outward steps around the lower part of the sidewall. The cover is constructed with a plurality of adjacently placed perforations around the periphery of the lower sidewall on the same horizontal plane. The lower section of the sidewall may be torn away at these perforations to lower the total height of the cover.

11 Claims, 3 Drawing Sheets

CANDLE BEARING CEREMONIOUS CAKE SHIELD

BACKGROUND OF THE INVENTION

1. Field of the Invention

This invention reltes to the field of covers for cakes, and in particular to covers for ceremonious cakes such as birthday and wedding cakes.

2. Prior Art

It is known in our society to celebrate the occasion of a person's birthday or wedding through a large gathering of the person's family and friend. In the case of birthdays, the celebration may culminate with the entire gathering grouped around a cake singing a birthday song to the celebrant. The cake is traditionally highly decoratvie and includes a well-wishing message to the celebrant written on its surface in edible icing. A number of candles are mounted onto the top surface of the cake and are lit and burned through the song-singing portion of the ceremony. The cake, therefore, becomes the centerpiece of the joyous occasion.

At the conclusion of the song the celebrant is called upon to blow out the candles and is urged, especially if the celebrant is a young child, to blow out all of the candles with one breath.

Burning the candles and blowing them out by expelling air through the lungs and mouth combine to produce an unsanitary environment for the edible cake. The candle wax, which is allowed to drip upon the cak eas the candles burn, while not being extremely harmful, may ruin the appearance, texture and flavor of the cake. The act of blowing out the candles causes small particles of atomixed saliva to be blow upon the cake, polluting the cake with the germs and bacteria which are known to reside in the human mouth.

It is apparent, therefore, that celebrational edible cakes of this nature should be covered to protect them from melting wax, germs, and bacteria. It is important, though, that the cover be transparent to allow the decorative nature of the cake to be appreciated by the celebrant and party-goers. It would be further beneficial if the structure and design of the cover added to the aesthetically pleasing aspects of the cakes. Covers of this type should preferably contain wells or depressions to hold and support a plurality of birthday candles. As cakes of this nature vary substantially in height, it is also preferable to allow for height adjustment of the cake cover.

The prior art contains examples of cake covering apparatus. For instance, design Pat. No. 285,159 shows and describes an ornamental design for a combination cake cover and candle holder. It is known from U.S. Pat. No. 1,125,855 to Mapes to provide a simple, solid covering structure with holes in the top surface and a secondary layer to support the base of candles inserted through the holes in the top.

Shields such as the one disclosed in the patent to MacKendrick, U.S. Pat. No. 3,819,455 are also known to the prior art. The patent to MacKendrick disclsoes a two part shield comprised of open circular sidewalls and a cover to close off the top portion. Means to insert candles in the top portion are provided. The top portion is shown to rest directly upon the top surface of the cake.

Also known in the art are covers which do not fully extend down the sides of the cake. For example the U.S. Pat. No. 4,721,455-Barfus, discloses a panar cover with a center aperture that is supported above the top surface of a cake by a support member which is inserted into teh center of the cake. Barfus provides for candle support means. Similarly, the Valeta U.S. Pat. No. 2,960,770, discloses a cover for the upper surface of the cake but does not provide for full side coverage. The cover disclosed in Valenta is supported by posts extending downwards from the cover along the sides of the cake.

It is also known, from U.S. Pat. No. 4,219,119-Zefran to provide two piece decorative cake containers with remvoable decorations that are affixed to the top cover piece of the container. Containers of this type are themselves decorated with celebratory messages so that undecorated cakes may be used in the celebration.

It is also known from U.S. Patents, to McNeill and Pooch et al. U.S. Pat. Nos. 2,468,505 and 1,511,004 respectively, to provide candle holder structures which mount directly on the top surface of the cake. The main objective of such candle holders is to provide support for candles while preventing melted wax from dripping onto the top layer of the cake. When using candle holders of this nature, major portions of the cake remain uncovered.

None of the prior art devices used for covering or containing cakes provide the combiantion of decorativeness, complete coverage, candle holding means and means for height adjustment. There is a need, therefore, to provide a celebrational cake cover with the aforementioned desirable features.

SUMMARY FO THE INVENTION

It is a general object of this invention to provide a cake cover.

It is an object of this invention to provide a cake cover which will not detract from but might add to the decorative appearance of a celebrational cake.

Another object of the invention is to provide a cover for a decorative cake which has receptacles in its upper most surface for reception and support of celebrational candles.

A further object of the invention is to provide a decorative cake cover wherein it is possible to adjust the cover according to the height of the cake.

One further object is to provide a cake cover which is disposable but which also includes adjustability features.

In accomplishment of these objects, a one piece, dome-shape structure is provided. The structure is mounted over the cake and has sidewalls extending down along the sides of the cake. The device can be of circular or rectangular shape depending upon the shape of the cake which is to be covered. The cover should be constructed of a transparent material, such as celluloid, to allow party-goers and celebrants to view the highly decorated, attractive, celebrational cake. In furtherance of the object of providing an aestatically pleasing cake cover, the device is made with a number of structural features to accentuate its attractiveness. For instance, the sidewalls can be made to gently taper outwards and small outward steps can be place in the lower part of the sidewalls. It is also possible and desirable to include arched windows adjacently placed around the perimeter of the sidewalls.

It is also necessary and desirable for the cover to contain depressions on its top surface for placement of candles or candle numbers therein. These depressions can be placed anywhere along the top surface of the cover or could be concentrated around the perimeter to present a neat, organized appearance.

To produce the capability of varying the height of the cover, the cover should be manufactured with a series of small perforations on the same horizontal plane around the periphery of the sidewall. A boundary of perforations can be placed in the sidewall at more than one horizontal plane. In this manner a suitable section of the sidewall can be torn away at the perforations to effect a shortening of the length of the sidewall and an associated reduction in height of the overall cover.

The above-listed preferred aspects are not intended as limiting. For instance, the cover can be produced with all or only some of the above listed features. The cover might also be constructed so as to be disposable or reusable. The cover is also producible in varying diameters and rectangular dimensions to cover a variety of cake sizes. They may be constructed so as to be readily stackable within each other so as to require minimal storage space.

DETAILED DESCRIPTION OF THE INVENTION

Figure 1:
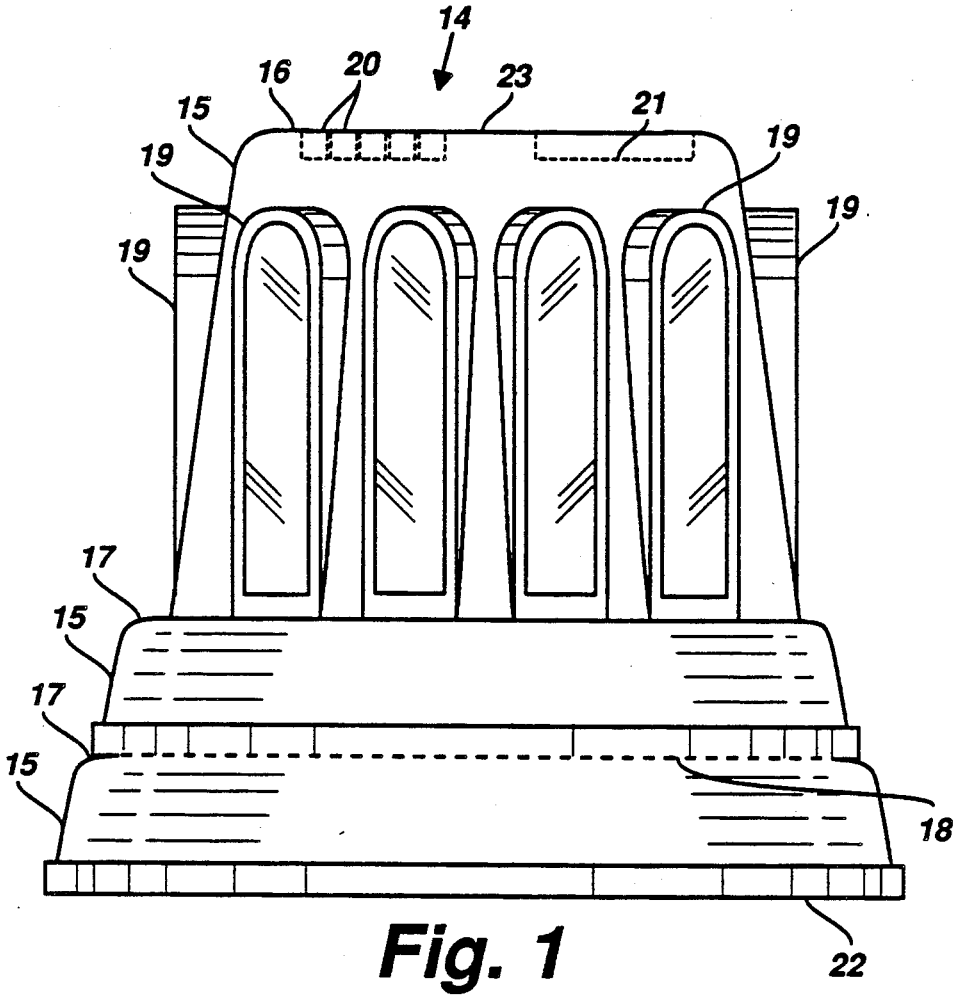
FIG. 1 is a side view of the circular dome-shaped embodiment of the invention.

Referring to FIG. 1, the cover 14 is shown from the side. FIG. 1 specifically portrays a side view of a round cake cover 14, although the side representation of a rectangular cover 14 would be similar in appearance and structure. As seen in FIG. 1 sidewall 15 is shown to taper slightly outwards from horizontal top 16. This is not limiting, as cover 14 can be constructed with sidewall 15 depending straight downward from horizontal top 16 so as to join with horizontal top 16 at a right angle. Towards the lower part of cover 14 outward steps 17 are present. Outward steps 17 are not required elements of cover 14 and could be eliminated from inclusion in the design of cover 14. A single row of perforations 18 travel around the periphery of sidewall 15 on a single horizontal plane. By this design, a bottom section of cover 14 can be torn away at perforations 18 to remove a bottom section from cover 14. This feature allows the user to quickly and easily adjust the height of cover 14 to correspond with the cake which is to be covered. Although one set of perforations 18 on a single horizontal plane is shown in FIG. 1, the perforations can exist in a plurality of horizontal planes to more accurately tailor the height of the cover 14.

In order to enhance the aesthetic appearance of the cover, a plurality of arched windows 19 are placed in sidewall 15. These windows 19 can lay flat along sidewall 15 or jut outwards from sidewall 15 as shown in FIG. 1.

A plurality of candle holding depressions 20 are distributed about the surface of horizontal top 16. These depressions 20 can be circular in cross section to contain and support the standard birthday candle but a square crossed section depression 20 would suffice. The candle holding depression 20 can be distributed in any pattern across horizontal top 16 or may be located substantially around the edges of horizontal top 16.

Provisions are made in horizontal top 16 to allow for the substitution of wax numbers of wax candles. In the instance where wax numbers are used in the celebration, for instance to designate the age of the celebrant or an anniversary year, slot 21 can be utilized to contain and support such wax numbers.

On the underside of horizontal top 16, center support 23 can be fixedly attached. Center support 23 is an optional feature and when included, normally resides above the cake but if necessary, will rest on the top surface of the cake to add support to horizontal top 16 and prevent horizontal top 16 from collapsing upon the top surface of the cake and destroying its decorative features.

Figure 2:
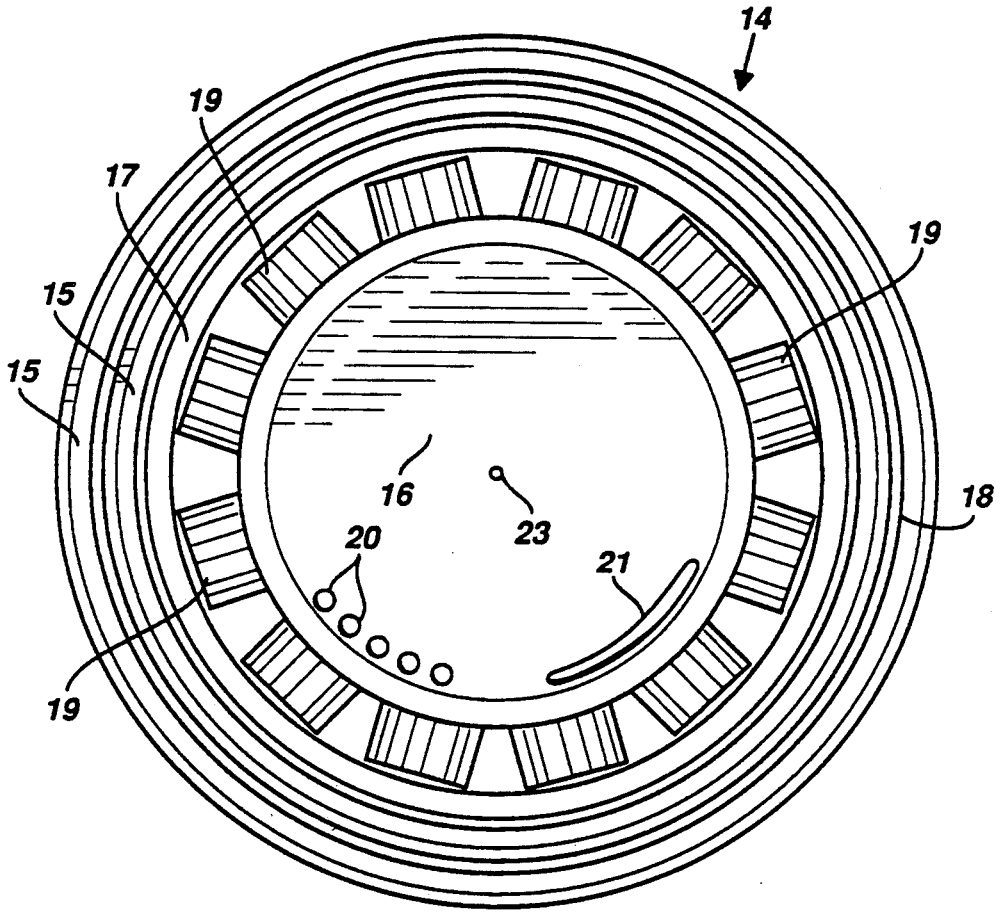
FIG. 2 is a top view of the circular dome-shaped embodiment of the invention.

Referring to FIG. 2, a top view of the circular embodiment of the cake cover 14 is show. Candle holding depressions 20 are shown to reside near the edge of horizontal top 16 but as earlier noted may be distributed anywhere about the surface of horizontal tp 16. Cover 14 is shown to have horizontal steps 17 to step sidewall 15 outwards into a larger diameter culminating in bottom edge 22. Perforations 18 are visible in proximity to bottom edge 22. Arched windows 19 are shown to be of the type that protrude outward from sidewall 15.

Figure 3:
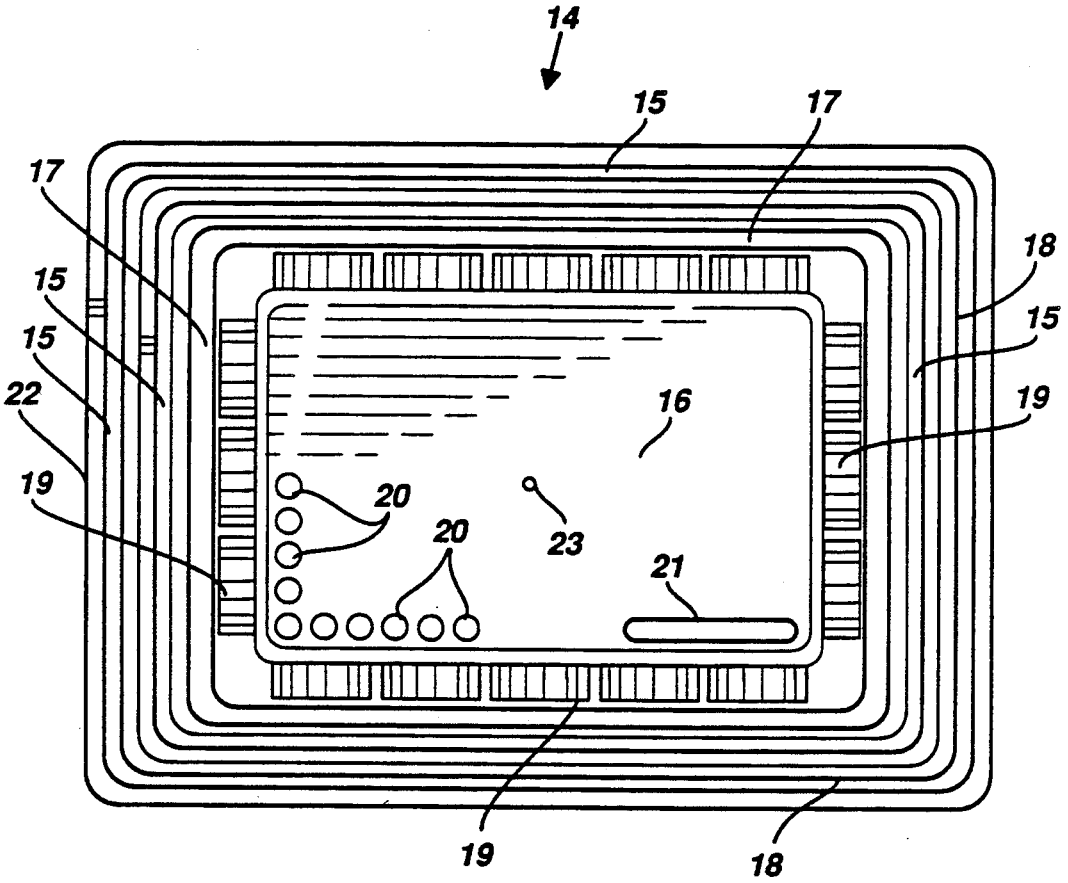
FIG. 3 is a top view of the rectangular shaped embodiment of the invention.

FIG. 3, depicts cover 14 with identical features as shown in FIGS. 1 and 2 except that the cover is of rectangular shape.

Although a few particular embodiments of the invention have been shown and described, various other forms and embodiments of the cover are possible within the scope of the invention claimed. Further modifications of the cover within the scope of the invention should now be apparent to those skilled in the art in view of this disclosure. Accordingly, reference should be made to the appended claims rather than the foregoing specification in assessing the scope of the invention in which exclusive rights are claimed.

What is claimed is:

1. A cake shield to be used with varying sized ceremonious cakes comprising:

a cover having a horizontal, transparent top and a sidwall extending downward from a perimeter from said top, said sidewall having upper and lower parts and a bottom edge, said lower part having at least one set of perforations arranged substantially horizontally and continuously around a periphery of said lower part, said set of perforations providing means for adjusting a height of said shield by allowing said lower part to be town away from said upper part along said set of perforations, said horizontal top having a plurality of depressions in an upper surface of said horizontal top for mounting candles therein, said lower part providing at least one outer step for increasing a bottom perimeter formed by said bottom edge of said sidewall.

2. The cake shield recited in claim 1 wherein the sidewall tapers outward at a slight angle from said horizontal, transparent top.

3. The cake shield recited in claim 1 further comprising a plurality of deprwsions distributed about the surface of said horizontal, transparent top for mounting candles therein.

4. The cake shield recited in claim 6 wherien the depressions are located substantially at the edge of said horizontal, transparent top.

5. The cake shield recited in claim 1 further comprising at least one slotted depression for mounting of candle numbers therein.

6. The cake shield recited in claim 1 further comprising a plurality of arched windows in said sidewall.

7. The cake shield recited in claim 1 wherein the shield is disposable.

8. The cake shield recited in claim 1 wherein the shield is manufactured from a transparent material.

9. The cake shield recited in claim 1 wherien the horizontal, transparent top is circular.

10. The cake shield recited in claim 1 wherein the horizontal, transparent top is rectangular.

11. A shield according to claim 1, wherein said sidewall is integrally connected to said periphery of said horizontal, transparent top.

* * * * *

UNITED STATES PATENT AND TRADEMARK OFFICE

CERTIFICATE OF CORRECTION

PATENT NO. : 5,096,274

DATED : March 17, 1992

INVENTOR(S) : FUSCHETTO et al.

It is certified that error appears in the above-identified patent and that said Letters Patent is hereby corrected as shown below:

item [22]

On the title page, the filing date should read --June 14, 1990--.

Column 1, line 13, replace "friend" with --friends--.
line 30, replace "cak" with --cake--.
line 31, replace "eas" with --as--.
line 60, before "the" replace "to" with --in--.
line 60, replace "disclsoes" with --discloses--.
line 68, replace "panar" with --planar--.

Column 2, line 2, replace "teh" with --the--.
line 11, replace "remvoable" with --removable--.

Column 2, line 31, replace "FO" with --OF--.

Column 4, line 2, before "wax" replace "of" with --for--.
line 19, replace "tp" with --top--.
line 43, replace "sidwall" with --sidewall--.
line 50, replace "town" with --torn--.
line 63, replace "deprwsions" with --depressions--.

UNITED STATES PATENT AND TRADEMARK OFFICE

CERTIFICATE OF CORRECTION

PATENT NO. : 5,096,274

DATED : March 17, 1992

INVENTOR(S) : Fuschetto, et. al.

It is certified that error appears in the above-indentified patent and that said Letters Patent is hereby corrected as shown below:

Column 6, line 3, replace "wherien" with --wherein--.

Signed and Sealed this

Fifteenth Day of June, 1993

*Attest:*

Michael K. Kirk

MICHAEL K. KIRK

*Attesting Officer*

*Acting Commissioner of Patents and Trademarks*